United States Patent [19]

Hino et al.

[11] 4,086,751

[45] May 2, 1978

[54] PROCESS FOR PRODUCING A FUSED FALSE TWISTED CONTINUOUS FILAMENT YARN HAVING CRISPNESS CHARACTERISTICS OF HARD HIGH-TWIST YARN

[75] Inventors: Hajime Hino; Yoshiyuki Sasaki, both of Takatsuki; Toshio Sekiguthi, Ibaraki; Masaaki Yao, Matsuyama, all of Japan

[73] Assignee: Teijin Limited, Osaka, Japan

[21] Appl. No.: 765,481

[22] Filed: Feb. 4, 1977

[30] Foreign Application Priority Data

Feb. 16, 1976 Japan ..... 51-14811

[51] Int. Cl.[2] ..... D02G 1/02

[52] U.S. Cl. ..... 57/157 TS

[58] Field of Search ..... 57/157 S, 157 TS

[56] References Cited

U.S. PATENT DOCUMENTS

| | | | |
|---|---|---|---|
| 3,936,999 | 2/1976 | Okeda et al. | 57/157 TS |
| 3,956,878 | 5/1976 | Schaffer et al. | 57/157 TS |
| 3,978,647 | 9/1976 | Kosaka et al. | 57/157 TS X |

*Primary Examiner*—Richard C. Queisser

*Assistant Examiner*—Charles Gorenstein

*Attorney, Agent, or Firm*—Sughrue, Rothwell, Mion, Zinn and Macpeak

[57] ABSTRACT

False-twisted yarn uniformly fused in alternate s- and z-twisted state, and having crispness characteristic of hard twist yarns is provided from partially oriented polyester filament yarn by subjecting the said polyester filament yarn to simultaneous draw false-twisting process employing lower draw ratio, lower number of false twists and higher heat setting temperature.

The partially oriented polyester filament yarn used as a feed yarn has birefringence value of 0.03 - 0.10 and break elongation of 70 - 200%. General range of processing conditions is such that draw ratio of 0.7 $R_o$ - 0.95 $R_o$ wherein $R_o$ is an apparent draw ratio to impart a drawn yarn break elongation of 30% when a feed yarn is drawn at such draw ratio ($R_o$), false twist per meter of $15000/\sqrt{De}$ - $28000/\sqrt{De}$ wherein De stands for a denier of the yarn passed a false twisting mean, and heat setting temperature of 225° - 255° C. These three conditions are also interrelated each other for stable operation of simultaneous draw false-twisting for obtaining uniformyly fused yarn.

7 Claims, 6 Drawing Figures

(x400)

PROCESS FOR PRODUCING A FUSED FALSE TWISTED CONTINUOUS FILAMENT YARN HAVING CRISPNESS CHARACTERISTICS OF HARD HIGH-TWIST YARN

This invention concerns a process for producing a fused false twisted continuous filament yarn having crispness characteristic of hard twist yarns. More particularly this invention relates to a process for producing the above mentioned yarn from a polyester continuous filament yarn as a feed yarn, which can find its use especially as for crepe georgette.

It is well known in the field that fused false-twisted filament yarns render lody as well as crispness on woven and knitted fabrics. A process for manufacturing such false-twisted filament yarn, can be divided into two categories. One is such that blended on doubled filament yarn comprised of at least two kinds of filaments having different melting points is heated between a temperature above the lower melting point of a material and still under the higher melting point of the other while the said blended or doubled filament yarn is in highly false twisted state. The other one is to employ a single ordinary fully drawn filament yarn in such manner that the said filament yarn is heated to a high temperature immediately before the wholly fusion of the filaments occurs. (Japanese Pat. Publication 49457/1972)

The former method requires not only separate spinning processes for each of different filament yarns but also doubling or blending step for obtaining a feed yarn ready to be false-twisted, thus arising complicated and troublesome work prior to processing. On the other hand, the latter has an advantage of saving separate spinning and doubling or blending step in the sense the single filament yarn which can be used as the starting materials. However, as a vital deffect of this process it can be said that an acceptable range of conditions such as a number of twists, heater temperature is remarkably restricted to narrow range and a little bit of variance of the conditions leads directly to unevenness of the resulting products with respect to dye absorption due to irregular fusion of filaments. Further the woven or knitted fabrics made up of the processed filament yarn obtained in accordance with the latter process, show a excessive ridity, in other word, too harsh, too coarse hand, occasionally far beyond crispness characteristics of the fabrics made up of the conventional high twist yarn.

The primary object of the present invention is to provide a novel process which affords to widen acceptable range of processing conditions for obtaining a uniformly fused filament yarn during false-twisting.

Another object of the present invention to provide a process for producing a fused false twisted filament yarn having a diminished rigity while maintaining its crispness character of hard twist yarn to realize crepe-georgette effect on fabrics.

A still another object of the present invention is to provide such filament yarn from single filament yarn.

In according to the present invention there is provided a process for producing a fused false-twisted continuous filament yarn having crispness characteristics of hard twist yarns, which comprises a. forwarding a polyester continuous filament yarn as a feed yarn having both birefringence value of 0.03 – 0.10 and break elongation of 70 – 200% to simultaneous draw-false twisting zone comprising a feed roll assembly, a heater, false twisting mean and draw roll assembly in sequence.

b. false twisting the same at a number of turns per meter expressed by $\alpha \times 1000/\sqrt{De}$ wherein $\alpha$ is a twist coefficient of 15 – 28, and De means a denier of the yarn which has passed the false twisting mean c. heating the said twisted yarn to a temperature of 225° – 255° C and simultaneously drawing the yarn at a draw ratio of $R_1 \times R_0$ wherein $R_1$ is a draw coefficient of 0.7 – 0.95 and $R_0$ is an apparent draw ratio to impart a drawn yarn break elongation of 30% when the feed yarn is drawn at such draw ratio ($R_0$)

d. untwisting the heat-set and drawn yarn and consequently withdrawing the resulting yarn.

The background of the concept of the present invention resides in the inventor's discovery that, in a false-twist texturing of polyester continuous filament yarn accompanied with fusion of the component filaments caused during heat-setting of the false-twist, certain combined range of a lower number of twists and a higher heat-setting temperature both in relation to a simultaneous-drawing ratio, tends to result in fairly uniform product yarn, with a proviso that as a feed yarn, continuous filament yarn of polyester type having rather loose fibre structure, known as partially oriented filaments, for example, than conventional fully drawn filament of the same polymer composition is used.

Further features and advantages of the present invention will be made clear from the following description together with the accompanying drawings.

Figure 4A:
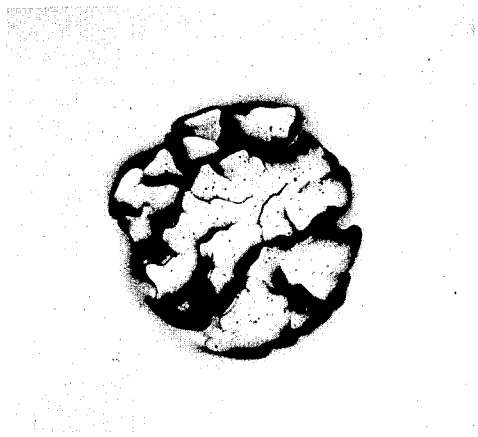

FIG. 4*a* is a photographical drawing showing a transverse section of a yarn according to the invention.

Figure 5:
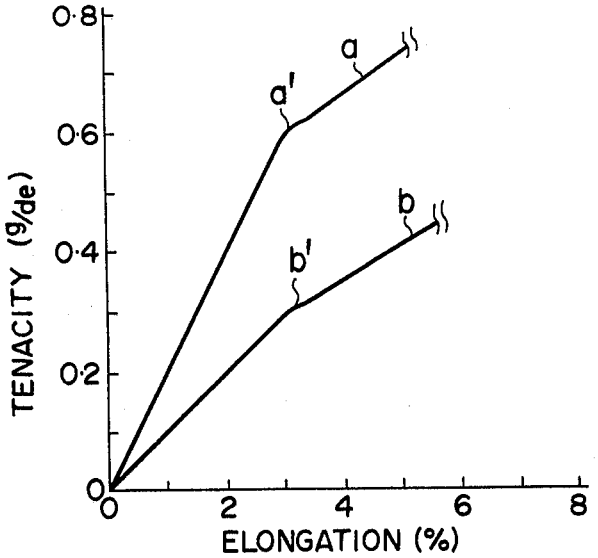

FIG. 5 is a graphical drawing showing stress-strain curve of a yarn according obtained by one of the embodiments to the invention.

Figure 4B:
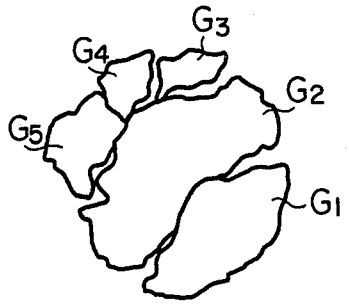

FIG. 4*b* is a traced drawing of FIG. 4*a*, explaining the fused and adhered state of the transverse section of a yarn according to the invention.

Figure 1:
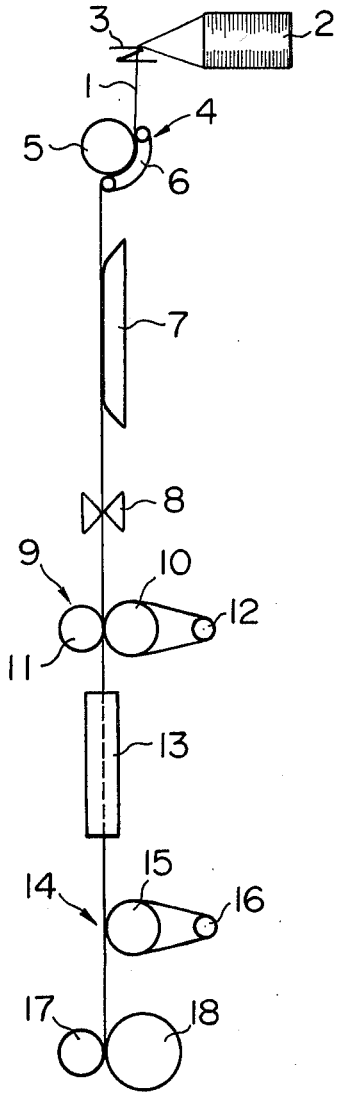
FIG. 1 is a diagrammatic representation of one embodiment of the process of the present invention.

Referring now to FIG. 1, polyester continuous filament yarn 1, of birefringence value of 0.03 – 0.1 and break elongation of 70% – 200%, unwound from a package 2 is guided via guide 3 to a feed roll assembly 4 comprising roll 5 and apron belt 6. From the said assembly 4 the filament yarn enters a simultaneous draw-false twisting zone comprising a heater 7, a false twisting means 8 and draw roll assembly 9 comprising a draw roll 10 rotating at a higher surface speed compared with that of the feed roll assembly 4, nip roll 11 and separator roll 12. On passing the feed roll assembly 4, the filament yarn is subjected to false twist action exerted by the false twist mean 8 and simultaneously to drawing action exerted by the draw roll assembly 9, and false twists imparted to the yarn is heat-set on a heater 7 which is maintained at a temperature of at least 225° C. At the time of heat-setting, each of the component filaments is fused at its surface portion and adhered each other to form a temporarily combined yarn. This yarn is then subjected to untwisting action exerted by a false twisting mean 8 when the yarn passes the said mean 8. The untwisted yarn is further heat treated in an overfed state. Overfeed of the yarn can be adjusted between the draw roll assembly 9 and delivery roll assembly 14 comprising delivery roll 15 and separator roll 16, and rotating at lower surface speed than the draw roll assembly 9. Then heat-treated yarn is withdrawn via a delivery roll assembly 14 and taken up on a bobbin 17 frictionally rotating by a positively driven roll 18.

This second heat-treatment between the draw roll assembly 9 and the delivery roll assembly 14, however, is not essential in a sense that fusion of the filaments is not caused on a second heater 13.

In carrying out the present invention, a limited selection of a number of twists, yarn temperature and draw ratio becomes extremely important to obtain a desired product. This point is further explained in detail, using FIG. 2 and FIG. 3.

Figure 2:
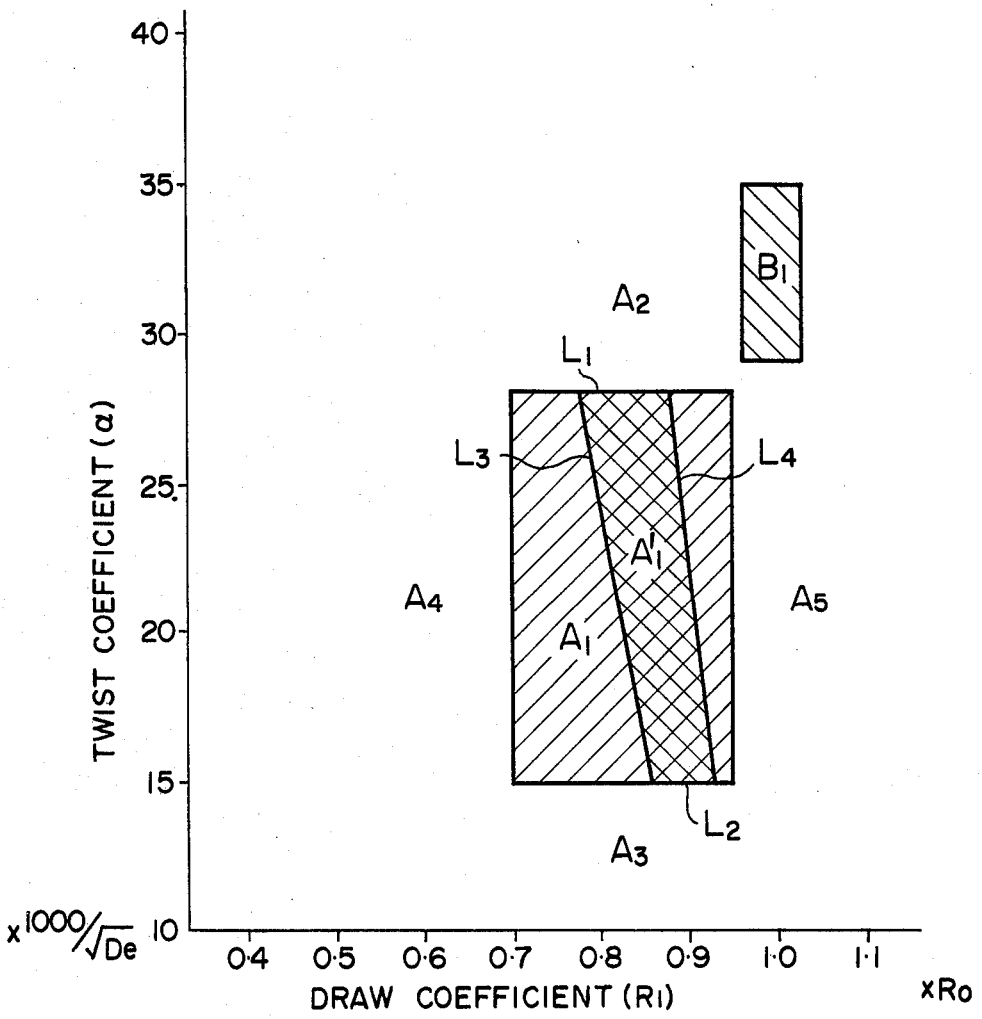
FIG. 2 is a graphical drawing showing a relationship between twist coefficient ($\alpha$) and draw coefficient ($R_1$).

In FIG. 2, twist coefficient ($\alpha$) against $1000/\sqrt{De}$ is taken on the ordinate, and a draw coefficient ($R_1$) against $R_0$ is taken on the abscissa. A general range of twist coefficient ($\alpha$) and a draw coefficient ($R_1$) employed according to the invention is shown in the hatched area $A_1$ commonly comprising the cross hatched area $A'_1$, and preferred range is shown in the said cross hatched area $A'_1$. As shown in FIG. 2, the upper limit of $\alpha$ is 28, which means the maximum false twist is $28000/\sqrt{De}$ while the lower limit thereof is 15 which means the minimum false twist number is $15000/\sqrt{De}$ wherein De is a denier of the yarn which has passed the false twist mean. Usually this De is calculated by dividing an initial denier of the feed yarn by a draw ratio ($R_1 \times R_0$). As regard to draw coefficient ($R_1$) it must be within the range of 0.7 - 0.95, which is multiplied by apparent draw ratio ($R_0$) upon the determination of a draw ratio ($R_1 \times R_0$) at which simultaneous draw-false twisting is practised.

Further the preferred area $A'_1$ in FIG. 2, is surrounded by lines $L_1$, $L_2$, $L_3$ and $L_4$, each of which is expressed by the following equations, respectively.

$L_1 \ldots \alpha = 28$
$L_2 \ldots \alpha = 15$
$L_3 \ldots R_1 = (-\alpha/160) + 0.95$
$L_4 \ldots R_1 = \alpha/260) + 0.99$ On the other hand, when a number of false twists locate in area $A_2$, $A_3$, $A_4$ or $A_5$, respectively, such inconvenience as hereinafter described occurs.

(a) In Area $A_2$:

A false-twisted yarn processed in this area bears an intermittently bulky portions along the axis of fibre, thus resulting in the irregular appearance on knitted goods.

(b) In Area 3

A false-twisted yarn processed in this area renders waxy hand similar to that of unprocessed filaments, thus not resulting in crispness character.

(c) In Area 4

A false-twisted yarn processed in this area shows an unacceptable rigidity due to excessive fusion of the filaments.

(d) In Area 5

A false-twisted yarn processed in this area has a bulky and high stretch character, thus crispness character is expected no longer.

On the other hand, a number of false-twists employed heretofore lies in the hatched area $B_1$ wherein simultaneous drawing has been conducted at draw ratio of $R_0$, using draw coefficient ($R_1$) of 1. When these area $A_1$ and $B_1$ are compared, it will be apparent that a number of false twists used in the present invention is fairly below the conventional one and still important is that this number of false twists must be prescribed in relation to draw coefficient $R_1$ selected from a range of 0.7 - 0.95 preferrably 0.78 - 0.93.

Figure 3:
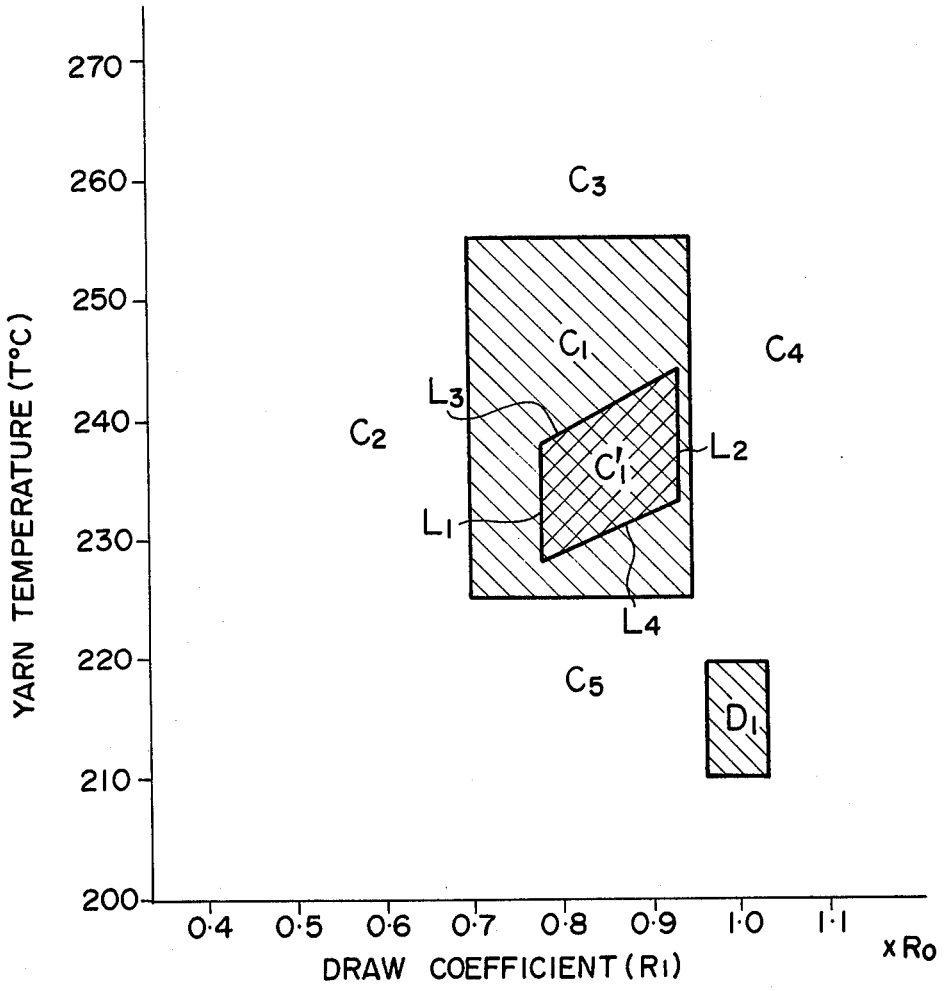
FIG. 3 is a graphical drawing showing a relationship between a temperature (T) of filament yarn during heat-setting and draw coefficient ($R_1$).

In addition to the employment of limited number of false twists, a temperature of filament yarn travelling on a heater 7 is very important, and this must be also prescribed in relation to draw coefficient $R_1$, as shown in FIG. 3. In FIG. 3, a yarn temperature on a heater is taken on the ordinate, and draw coefficient ($R_1$) is taken on the abscissa. A yarn temperature (T°C) and draw coefficient ($R_1$) available to the present invention is shown in the hatched area $C_1$ commonly including the cross hatched area $C_1'$, and preferred range is further shown in the said cross-hatched area $C_1'$. As clear from FIG. 3 general range of a yarn temperature must be within the range of 225° - 255° C. Further the preferred range $C_1'$ is surrounded by lines $L_1$, $L_2$, $L_3$ and $L_4$, each of which is represented by the following equations, respectively.

$L_1 \ldots \alpha = 0.78$
$L_2 \ldots \alpha = 0.93$
$L_3 \ldots T = 40R_1 + 207$
$L_4 \ldots T = 40R_1 + 197$ Therefore, yarn temperature employed in relation to draw coefficient $R_1$ must satisfies the above mentioned four conditions at the same time in the preferred embodiment of the invention. Now the significance of the relation between yarn temperature (T°C) and draw coefficient ($R_1$) and the meaning of limitation is explained. The processed yarns obtained in area $C_3$ or $C_4$ both outside the scope of the invention, shows overfused state of filament to form unitary combined yarn of irregular fusion like a mono-filament and renders more excessive rigidity of an unacceptable hand. On the other hand, the processed yarn obtained in area $C_4$ or $C_5$ both outside the scope of the invention has a bulky and high stretch character, thus crispness character is expected no longer.

Typical example of a polyester continuous filament yarn used in the present invention is partially oriented filaments consisting of a polyester containing at least 80% of ethylene terephthalate units, and having birefringence value of 0.03 - 0.10, preferrably 0.04 - 0.08 and still break elongation of 70% - 200% preferrably, 90% - 180%.

The preferred polyester is polyethylene terephthalate, but there may also be used copolyesters containing less than 20% of other copolymerizable acidic or alcoholic components. Example of other acid component to be copolymerized with ethylene terephthalate include dibasic acid such as phthalic acid, isophthalic acid, adipic acid, oxalic, etc. Example of other alcohol components that can be copolymerized with ethylene terephthalate are dihydric alcohols such as polymethylene glycols having 2 - 10 carbon atoms, cyclohexane-dimethanol.

The polyester may contain a minor amount of a modifier such as 5-oxydimethyl isophthalate, 5-oxydimethyl hexahydroisophthalate, benzene-1,3,5-tricarboxylic acid, para-carbomethoxyphenyl diethyl phosphonate, 3,5-dicarboxy phenyl diethyl phosphate, pentacrythritol.

The partially oriented polyester continuous filament yarns used in the present invention may be obtained by melt-spinning the above-mentioned polyesters at a winding speed of 2500 – 5500 m/min. Or these may be obtained by drawing, at draw ratio of 1.5 – 2.5, ordinary undrawn yarn obtained at winding speed of less than 2500 m/min.

In the present invention the former is preferably used, hence it has lower fusing point compared with that of ordinary fully-drawn yarn and still shows a rather broader temperature range as acceptable one, thus excluding ununiformity of fusion and ensuring evenness in fusion of partially fused products.

In case that break elongation exceeds 200% and birefringence value is less than 0.03, of the polyester continuous filaments, said filaments show an extremely weak orientation of molecules and is apt to melt out easily on a heater loose its fibre structure.

On the other hand, in case that birefringence value exceeds 0.10 and break elongation becomes less than 70%, of the polyester continuous filament yarn, such yarn tends to show a rigid physical behavior similar to that of fully drawn yarns, narrowing a possible and acceptable fusing range of temperature.

These filament yarn may have not only a circular cross section, but also a non circular section such as triangle, quadangle, pentagonal section. Especially preferred are those having delta-type section.

Simultaneous draw-false twisting operation may be conducted by using any false twisting machine so long as it has a drawing function.

As a false twist means 8, a hollow spindle type may be preferably used but any other type such as outer friction type, inner friction type may be used occasionally. Heater 7 may be contact type (plate heater) or non-contact type (pipe heater) and heater temperature should be maintained at least to 225° C so as to cause filaments fused and adhered each other. For this purpose length of a heater is also to be taken into account, in relation to processing speed, yarn denier, etc.

With regard to a number of false twists and yarn temperature on a heater, it is already mentioned that both of them are combiningly determined in relation to draw coefficient $R_1$. Employment of said draw coefficient $R_1$ within the range of 0.7 – 0.95 against $R_0$ inherent of the feed yarn arises lowering of fusing temperature of the component filaments and broaden acceptable fusing temperature for fuse uniformity of the product 2 – 3 times compared with that of conventional false twisting using about 1 as $R_1$.

This expansion of an acceptable range of fusing temperature is also achieved by adoption of a lower number of false twists defined in FIG. 2, widening said range of acceptable fusing temperature 3 – 4 times compared with a case when conventional fully drawn yarns are processed at usual number of false twists, say, $29000/\sqrt{De} - 35000/\sqrt{De}$.

A fused false-twisted continuous filament yarn obtained according to the present invention takes a form of alternate s- and z-twist which is heat-set in such manner that each component filaments fused at its surface portion are adhered each other by help of compressive force exserted thereto by said twists. As to physical properties of the yarn, it shows a crimp elongation of substantially zero, nevertheless, posses strong torque, and comfortable dry hand like hard twist yarns.

Another feature to be noted of this type of yarns is that at the transverse section thereof, it can be splitted into at least three groups of fused and adhered filaments, as shown in FIGS. 4*a* and 4*b*.

FIG. 4*a* is explained referring to FIG. 4*b* which is traced one of the photographical drawing in FIG. 4*a*. In FIG. 4*b*, $G_1$, $G_2$, $G_3$, $G_4$ and $G_5$ represent independent group of filaments fused and adhered each other, and also, temporarily adhesion due to fusion occurs among the groups of the said filaments in such manner that adhesive force among the groups is weaker than that of the intra-filaments group. Thus knitted goods made up of the yarns obtained according to the invention shows as a whole not only a desired crispness due to lowered rigidity but acceptable lody and soft hand.

For the improvement of said lody, it is advantageous that processed yarn passing draw roll assembly 9 in FIG. 1 is subjected to further heat treatment in relaxed state at an overfeed ratio of 2% – 7%.

This second heat treatment is widely known to serve to diminish torque possessed by the false twisted yarn if said yarn is secondly heat-treated while it is overfed to said heat treating zone at an overfed ratio of 10% – 20%. On the contrary, according to the invention, a limited overfeed of 2% – 7% combined with heat treatment contribute to improve a first yield point, in relation to the physical properties of the fused yarn. In addition, this second heat treatment serves to diminish torque of the yarn to less than 50 twist/meter, thus knitting operation can be ensured.

In FIG. 5, a shows a stress-strain curve of the yarn after it is heat treated on a second heater at a second overfeed ratio of 4%; whereas b shows a stress-strain curve of the yarn after it is heat treated on a second heater at an overfeed ratio of 15%. From the comparison of these curves, it will become clear that the lower second overfeed on a second heater result in the yarn with strength at higher first yield point (*a'*) compared with that (*b'*) of the yarn processed at a higher second overfeed. And the yarn with strength at first yield point of at least 0.5 gr/de withstand a stress exerted thereto at the time of knitting which is usually 0.5 gr/de or more, thus tight pick phenomina never occurs on the yarn, enabling to obtain a knitted good with excellent appearance and smoothness of stitches.

Thus according to the present invention a fused false twisted polyester continuous filament yarn of highly improved crispness and evenness in dye-effect can be obtained by dexterously combining the birefringence and break elongation of the polyester filaments, the conditions of false twist numbers and heat setting temperature both dependent upon draw coefficient $R_1$ within a specific range of 0.7 – 0.95. The advantage of the present invention reside in the fact that uniformly fused false twisted yarn can be obtained in spite of employing severe treatment under higher temperature than conventional false twisting process. In addition there is hardly any change in the difference in fusion of the yarn, namely the difference of dye exhaustion, and no inspection is necessary to sort out the yarns according to the difference of dye exhaustion. Moreover adoption of a lower number of false twists helps to increase the speed of processing to a marked extent, and this has a great industrial significance.

The following examples illustrate but do not limit the present invention.

The birefringence value, break elongation crispness, torque second overfeed ratio, strength at first yield point dye evenness heretofor or used in the examples are defined as follows:

(A) Birefringence ($\Delta n$)

Sodium D rays (wavelength 589 millimicrons) are used as a light source, and the specimen filaments are disposed in a diagonal position. The birefringence ($\Delta n$) of the specimen is computed from the following equation:

$$n = (n^{\lambda} + r/\alpha)$$

where $n$ is the interference fringe due to the degree of orientation of the polymer molecular chain; $r$ is the retardation obtained by measuring the orientation not developing into the interference fringe by means of a Berek's compensator; $\alpha$ is the diameter of the filament; and $\lambda$ is the wavelength of the sodium D rays.

(B) Break elongation

The top and bottom of a specimen filament yarn are fitted to the chucks of an Instron-type shopper so that the specimen length becomes 20 cm. The specimen is then pulled and elongation at break is read.

(C) Crispness

Knitted goods made up of the yarn obtained according to the invention is examined functionally with fingers. Touch of the said goods with regard to crispness is classified as follows:

: Excellent

O : Good

Δ : Acceptable x : Bad

The above rating applies also to "fusion uniformity", "lody", "draperbility", "lody" and "total quality" in the example.

(D) Torque (Tq)

A length of about one meter of the yarn is held in a generally horizontal position and a load of 1 mg/de is placed at the center of the yarn. The two ends of the yarn are then brought together, which causes the two halves of the yarn to twist together. The torque (Tq) is the number of twists in a length ($y$) of the double twisted yarn which contains two 25cm lengths of yarn (i.e. one 25cm length from each half of the yarn). Because the doubled yarns is shortened by the twisting together of the two halves, the length ($y$) is less than 25cm. The number of twists can be determined visually or by turning the load until all the twist is removed. Twenty such measurements are made and the average is taken.

(E) Strength at First Yield Point (Yp)

A sample is left to stand for a day at a relative humidity of 65% at 25° C. A 20cm sample is tested on an Instron Tensile Tester at a pulling rate of 100% per minute to measure the load-elongation curve. Strength at first yield point is a load at the first inflection point in the load-elongation curve.

(F) Second Overfeed Ratio $$\frac{\left(\text{surface speed of draw roll assembly}\right) - \left(\text{surface speed of delivery roll assembly}\right)}{\left(\text{surface speed of draw roll assembly}\right)} \times 100$$

(G) Dye Unevenness (Streaking)

The textured yarn is knitted into a cylindrical sleeve 3 inches in diameter and 2 inches in length. This is then dyed under the following conditions with "Eastman Polyester Blue GLF".

Dye Concentration: 4% o.w.f. (based on fiber)

Liquid Ratio: 1 : 50

Temperature: 60 minutes at boiling

After drying the dyed sleeve, it is examined with the naked eye. Where the dyed sleeve has streaks of deeply dyed portions in the peripheral direction, the sleeve is considered to be dyed unevenly (streaked).

EXAMPLE 1

Polyethylene terephthalate chips having an intrinsic viscosity of 0.65 were melted at 288° C, and extruded through a spinneret having 36 orifices each of which afford a delta type section, followed by winding up at winding speed of 3300 m/min. Total denier of this yarn was 115 and the filaments had birefringence value of 0.04 and break elongation of 150%. Further apparent draw ratio imparting break elongation of 30% to the drawn yarn after wound-up yarn was drawn was determined as 1.5.

This wound up filament yarn showing the abovementioned properties was subjected to the draw false twisting process in FIG. 1, under following conditions shown in table 1, in which the properties of the resulting yarn is shown at the same time. Other processing conditions common to all runs are as follows.

| | | |
|---|---|---|
| (1) | first heater temperature | 237° C |
| (2) | first heater length | 100 cm |
| (3) | yarn temperature on the heater | 231° C |
| (4) | 2nd heater temperature | 240° C |
| (5) | 2nd overfeed | 4% |
| (6) | draw-texturing speed | 90 m/min. |

The fusion uniformity of the knitted goods made up of the resulting yarns in each runs 1 – 9 was examined by dying each of yarns, and also crispness of knitted goods made up of each yarn was evaluated. The result was shown in table 1 at the same time. The knitted goods obtained showed very comfortable dry hand, good draperbility, lody and unevenness in dye-effect was not recognized.

Table 1

| Run No. | 1 | 2 | 3 | 4 | 5 | 6 | 7 | 8 | 9 |
|---|---|---|---|---|---|---|---|---|---|
| Twist coefficient $\alpha$ | 21 | 16 | 25 | 18 | 25 | 18 | 35 | 25 | 14 |
| Number of false twists (T/m) | 2211 | 1735 | 2585 | 1839 | 2711 | 1651 | 3619 | 2854 | 1474 |
| Draw coefficient ($R_1$) | 0.85 | 0.90 | 0.82 | 0.80 | 0.90 | 0.65 | 0.82 | 1.00 | 0.85 |
| Draw ratio ($R_1 \times R_0$) | 1.275 | 1.35 | 1.23 | 1.20 | 1.35 | 0.975 | 1.23 | 1.50 | 1.275 |
| Yarn structure at transverse section | | | | | | | | | |
| Numbers of block | 5 | 4 | 4 | 4 | 3 | 4 | — | — | 2 |
| Numbers of filament | 3,4,7 | 2,4,10 | 2,5,9 | 2,4,7 | 5,8 | 3,6,9 | — | — | 1,35 |
| In each group | 11,11 | 20 | 20 | 23 | 23 | 18 | | | |
| Fusion uniformity | ⊙ | ⊙ | 0 | Δ | ⊙ | Δ | 0 | ⊙ | ⊙ |
| Crispness | ⊙ | ⊙ | ⊙ | ⊙ | 0 | ⊙ | x | x | x |
| Lody | ⊙ | 0 | 0 | ⊙ | Δ | 0 | 0 | 0 | x |
| Draperbility | 0 | 0 | ⊙ | Δ | 0 | x | Δ | 0 | ⊙ |
| Total quality | ⊙ | ⊙ | ⊙ | 0 | 0 | x | x | x | x |

EXAMPLE 2

The same polyester continuous filament yarn used in Example 1 was subjected to draw false twisting processing in the same manner but varying the first heater temperature as shown in Table 2. Other conditions common to all runs in Table 2 are as follows.

| | | |
|---|---|---|
| (1) | twist coefficient | $\alpha = 21$ |
| (2) | number of false twists | (2211 T/m) |
| (3) | draw coefficient | $R_1 = 0.85$ |
| (4) | draw ratio | 1.275 |
| (5) | 2nd heater temperature | 240° C |
| (6) | 2nd overfeed | 4% |
| (7) | draw texturing speed | 90 m/min. |

The fusion uniformity of the knitted goods made up of the resulting yarns was examined by same procedure as in example 1. The result was shown in Table 2 at the same time.

Table 2

| Run No. | 10 | 11 | 12 | 13 | 14 |
|---|---|---|---|---|---|
| 1st heater temperature (° C) | 235 | 245 | 255 | 225 | 215 |
| Fusion uniformity | ⊙ | 0 | x | 0 | ⊙ |
| Crispness | ⊙ | ⊙ | ⊙ | 0 | x |
| Lody | ⊙ | ⊙ | ⊙ | Δ | x |
| Draperbility | 0 | Δ | x | 0 | 0 |
| Total quality | ⊙ | 0 | x | 0 | x |

EXAMPLE 3

The same polyester continuous filament yarn used in example 1 was subjected to draw false twisting processing in the same manner as Run No. 10 in example 2 but varying the condition of the 2nd overfeed ratio as shown in Table 3. The fusion uniformity of the knitted good made up of the resulting yarn was examined by the same procedure as in example 1. The result was shown in Table 3 at the same time.

Table 3

| Run No. | 15 | 16 | 17 | 18 | 19 | 20 |
|---|---|---|---|---|---|---|
| Overfeed (%) | 1 | 2 | 3 | 5 | 7 | 9 |
| 1st yield strength (g/de) | 1.2 | 1.0 | 0.84 | 0.59 | 0.52 | 0.44 |
| Torque (t/m) | 54 | 50 | 47 | 38 | 34 | 25 |
| Tight pick at knitting | non | non | non | non | non | yes |
| Fusion uniformity | x | 0 | ⊙ | ⊙ | 0 | 0 |
| Crispness | x | ⊙ | ⊙ | ⊙ | ⊙ | x |
| Lody | 0 | 0 | ⊙ | ⊙ | 0 | 0 |
| Draperbility | Δ | 0 | ⊙ | ⊙ | ⊙ | ⊙ |
| Total quality | x | 0 | ⊙ | ⊙ | 0 | x |

EXAMPLE 4

In Run No. 17, in Example 3, the wound up yarn in Example 1 was draw-false twisted, removing a second heater 13, delivery roll 15 and separator roll 16. Resulting fused yarn had first yield strength of 1.5 g/de and towque of 100 t/m.

During knitting operation of this fused yarn some trouble due to high torque occured, but knitted goods obtained showed nearly equal qualities to that of Run No. 17.

EXAMPLE 5

In example 1, polyethylene terephthalate chips were melted, extruded and wound up in exception that the nozzle type was varied from a delta type to a circular cross type. The obtained yarn had birefrigence value of 0.35, break elongation of 160 %, and apparent draw ratio $R_0$ of 1.53. This wound up yarn was draw-false twisted as same as in Run No. 1 in Example 1. The knitted good made up of the above-mentioned fused yarn was evaluated. The result was shown in Table 4.

Table 4

| Run No. 21 | |
|---|---|
| Fusion uniformity | ⊙ |
| Crispness | Δ |
| Lody | ⊙ |
| Draperbility | 0 |
| Total quality | 0 |

EXAMPLE 6

In Example 1, polyethylene terephthalate chips were melted, extruded and wound up in exception that the winding speed was varied shown in Table 5. The resulting yarn had the physical properties shown in Table 5. This wound up yarn was draw-false-twisted as same as Example 1, Run No. 1. The knitted goods made up of the above-mentioned fused yarn was evaluated. The result was shown in Table 5 at the same time.

Table 5

| Run No. | 22 | 23 | 24 | 25 | 26 | 27 |
|---|---|---|---|---|---|---|
| Winding speed (m/min.) | 2000 | 2500 | 3500 | 4500 | 5500 | 6000 |
| Birefringence | 0.02 | 0.03 | 0.05 | 0.07 | 0.10 | 0.12 |
| Break elongation (%) | 241 | 192 | 138 | 115 | 89 | 61 |
| Apparent draw ratio $R_0$ | 2.57 | 2.17 | 1.47 | 1.32 | 1.28 | 1.24 |
| Fusion uniformity | x | 0 | ⊙ | ⊙ | 0 | Δ |
| Crispness | 0 | 0 | ⊙ | ⊙ | 0 | Δ |
| Lody | 0 | 0 | ⊙ | ⊙ | 0 | Δ |
| Draperbility | 0 | 0 | ⊙ | ⊙ | 0 | x |
| Total quality | x | 0 | ⊙ | ⊙ | 0 | x |

EXAMPLE 7

Polyethylene terephthalate chips having an intrinsic viscosity of 0.62 were melted at 288° C, and extruded through a spinneret having 24 orifices, each of which afforded a delta type section, followed by winding up at winding speed of 1800 m/min. The wound up yarn was drawn 2.0 times at the temperature 85° C. The resulting yarn had total denier of 50, birefringence of 0.09, break elongation of 80% and apparent draw ratio ($R_0$) of 1.33. The above-mentioned drawn yarn was draw-false-twisted as same condition as Example 1, Run No. 1. The obtained fused yarn was woven and woven goods had following qualities.

| Run No. | 28 |
|---|---|
| Fusion uniformity | ⊙ |
| Crispness | 0 |
| Lody | ○ |
| Draperbility | ⊙ |

What is claimed is:

1. A process for producing a fused false-twisted continuous filament yarn having crispness characteristic of hard twist yarns, which comprises a. forwarding a polyester continuous filament yarn as a feed yarn having both birefringence value of 0.03 – 0.10 and break elongation of 70 – 200% to simultaneous draw-false twisting zone comprising a feed roll assembly, a heater, a false twisting mean and draw roll assembly in sequence, b. false twisting the same at a number of turns permmeter expressed by a $\alpha \times 1000/\sqrt{De}$ wherein $\alpha$ is a twist coefficient of 15 – 28, and De means a denier of the yarn which has passed the false twisting means, c. heating the same twisted yarn to a temperature of 225° - 255° C and simultaneously drawing the yarn at a draw ratio of $R_1 \times R_0$ wherein $R_1$ is a draw coefficient of 0.7 - 0.95, and $R_0$ is an apparent draw ratio to impart a drawn yarn break elongation of 30% when the feed yarn is drawn at such draw ratio ($R_0$), d. maintaining the following relation exists between $\alpha$ and $R_1$ $$(-\alpha/260) + 0.99 \geqq R_1 \geqq (-\alpha/160) + 0.95$$

wherein $\alpha$ and $R_1$ is same as hereinbefore defined, e. untwisting the heat-set and drawn yarn and consequently withdrawing the resulting yarn.

2. A process according to claim 1, in which the false twisted yarn is heated to a temperature (T) defined in ° C by the following equations:

$$40R_1 + 207 \geqq T(^\circ C) \geqq 40R_1 + 197.$$

3. A process according to claim 1, in which the feed yarn has a birefringence value of 0.04 - 0.08.

4. A process according to claim 1, in which polyester filament yarn comprises partially oriented filaments.

5. A process according to claim 1, in which a spindle type spinner is employed as the false twisting mean.

6. A process according to claim 1, in which the resulting yarn is further subjected to a second heat treatment in overfed state.

7. A process according to claim 6, in which the resulting yarn is overfed at an overfeed ratio of 2% - 7%.

* * * * *